United States Patent [19]

Rutter

[11] 4,249,348

[45] Feb. 10, 1981

[54] ADAPTER FOR HONING MANDRELS

[75] Inventor: Harold T. Rutter, St. Louis, Mo.

[73] Assignee: Sunnen Products Company, St. Louis, Mo.

[21] Appl. No.: 53,844

[22] Filed: Jul. 2, 1979

[51] Int. Cl.[3] ..... B24B 33/02

[52] U.S. Cl. ..... 51/338

[58] Field of Search ..... 51/330, 338–354, 51/355

[56] References Cited

U.S. PATENT DOCUMENTS

| | | | |
|---|---|---|---|
| 1,476,035 | 12/1923 | Benedict | 51/342 X |
| 2,350,969 | 6/1944 | Sunnen | 51/338 X |
| 2,376,851 | 5/1945 | Sunnen | 51/338 X |
| 2,543,515 | 2/1951 | Wagstaff | 51/339 |
| 2,638,721 | 5/1953 | Sunnen | 51/169 |

*Primary Examiner*—Gary L. Smith
*Assistant Examiner*—Robert P. Olszewski
*Attorney, Agent, or Firm*—Haverstock, Garrett & Roberts

[57] ABSTRACT

An adapter for a honing mandrel for finishing the interior surfaces of bores using a honing mandrel having an abrasive member positioned in an opening therein, a wedge member for radial adjustment of the abrasive member during a honing operation to maintain the abrasive member engaged with the bore being honed, the improvements comprising an adapter having means for receiving and supporting the honing mandrel, the adapter including a wedge engaging member adjustable thereon to engage the wedge member to permit longitudinal movement thereof in the mandrel but to prevent radial movement thereof, the adapter also including a pair of angularly related mandrel engaging and locating surfaces against which the mandrel is positioned during installation on the adapter, a threaded member adjustable in the adapter to maintain the mandrel against said locating surfaces, an elongated member having one end attached to said adapter and on an opposite end, said elongated member being biased under spring tension into engagement with the abrasive member on the mandrel to maintain the abrasive member under longitudinal and radial spring tension and to maintain contact between the wedge member and the abrasive member even when the wedge member is being retracted, and a radially extending spring member mounted on the adapter having an inner end portion anchored to the adapter and an opposite outer end portion engageable with the one end of the elongated member.

10 Claims, 8 Drawing Figures

ADAPTER FOR HONING MANDRELS

Many different honing mandrels and adapters therefor have been devised and used in the past with varying degrees of success and accuracy. One of the principal aims of a honing device that uses a rotating mandrel is to be able to mount the mandrel on a honing machine in such a manner that the axis of the mandrel will remain on or close to the axis of rotation and in alignment during the honing operation. It is common practice when honing with a rotating mandrel to radially increase the honing diameter by means of a longitudinally movable wedge member which has tapered surfaces that engage tapered surfaces on the stone assembly. Such wedges are operatively engageable by means on the honing machine which push them longitudinally along a groove in the mandrel during a honing operation in order to maintain the stone under load engaged with the work. Such devices are well known and work reasonably satisfactorily so long as the speed of rotation of the mandrel does not become excessive. A trend in honing, however, is to increase the speed of rotation of the mandrels, and this has resulted in the production of increased centrifugal forces acting on the mandrels and especially on the wedges used to adjust the radial positions on the mandrel of the work engaging abrasive members. In the past the wedge members have been relatively free to move radially in the mandrel and in the adapter including the end of the wedge that extends into the adapter. It is obvious, however, that any radial movement of the free end of the wedge causes some tilting of the wedge and any such tilting produces some tilting of the abrasive member and resulting inaccuracy in the surface being honed. Inaccuracy caused by wedge tilt tends to make the bore being honed tapered from end-to-end, the smaller diameter end being at the end of the bore that is most remote from the honing machine. Typical of honing mandrels and adapters of the type that have been used in the past are disclosed in Sunnen U.S. Pat. No. 2,376,851 which issued May 22, 1945. The patented construction also has means for spring biasing the stone assembly endwardly on the mandrel. The spring biasing means on the patented construction include a specially constructed coil spring mounted in a special bore provided therefor in the adapter and it also requires special means for anchoring the spring under tension in the bore. All of this increases the number of parts in the mandrel and increases the cost and complexity of the prior construction, and the construction of the prior art device also makes it relatively easy to damage or bend the spring means resulting in repair and maintenance problems. The present construction has improved spring biasing means which are relatively simple structurally, relatively insusceptible to damage, relatively easy to install and require fewer parts. The improved spring means are also less likely to be damaged or lost in the field.

It is therefore a main object of the present invention to provide an improved adapter construction for receiving and supporting a honing mandrel.

Another object is to provide a relatively inexpensive lightweight mandrel adapter having means to limit radial movement of the wedge adjusting means used for adjusting the radial position of a stone assembly.

Another object is to provide improved means to apply continuous longitudinal and inward radial spring pressure against a stone assembly in a honing mandrel.

Another object is to provide improved means for axially aligning a mandrel in an adapter.

Another object is to provide improved, more trouble-free means for mounting a spring member in a honing adapter assembly.

Another object is to reduce the weight of metal required in a honing adapter assembly and to increase its flexibility.

Another object is to reduce the number of parts required in an adapter assembly.

Another object is to reduce the labor required in the construction of an adapter assembly for a honing mandrel.

Another object is to enable honing at higher mandrel speeds without sacrificing accuracy.

Another object is to provide improved, more rigid, and more accurate means for mounting a honing mandrel in an adapter assembly.

Another object is to make it easier and less time consuming to accurately install a honing mandrel in an adapter assembly.

Another object is to minimize field adjustment and parts replacement in honing devices having mandrels and mandrel adapters.

These and other objects and advantages of the present invention will become apparent after considering the following detailed specification in conjunction with the accompanying drawings, wherein.

Figure 1:
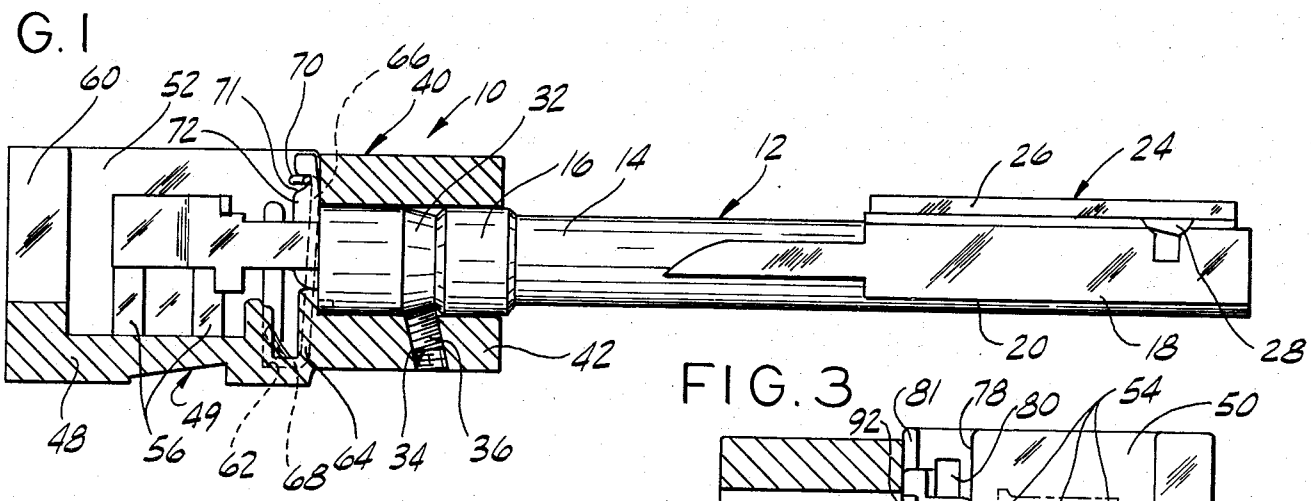
FIG. 1 is a side elevational view partly in section of an adapter assembly shown with a mandrel positioned therein and constructed according to the teachings of the present invention.

Referring to the drawings more particularly by reference numbers, number 10 refers to an adapter assembly constructed according to the present invention. The adapter assembly is shown in FIG. 1 having a honing mandrel 12 mounted therein. The honing mandrel 12 may be of a conventional construction such as the mandrels shown in Sunnen U.S. Pat. Nos. 2,376,851 and 2,638,721. The mandrel 12 has a shank portion 14 which extends between a round cyclindrical mounting portion 16 at one end and a honing portion 18 at the opposite end. The honing portion 18, as shown in FIG. 1, has a shoe portion 20 which is on one side of the mandrel and is a work engaging portion, and the mandrel has a full length slot or groove 22 formed extending downwardly into the mandrel from the upper surface as shown. The groove 22 receives an elongated honing assembly 24 which includes an abrasive work engaging portion 26 and a backing portion 28 which extends downwardly into the groove 22. The backing portion 28 has angularly related cam surfaces formed thereon (not shown) for engaging correspondingly sloping cam surfaces 29 formed on an adjustment member also referred to as wedge member 30. The adjustment member 30 extends most of the length of the mandrel 12 and partway through the adapter 10.

The cylindrical mounting portion 16 of the mandrel 12 has an annular tapered groove 32 formed therein, and when the mandrel 12 is mounted in the adapter 10 as shown, the groove 32 overlies a threaded bore 34 formed in the adapter to receive a threaded locking member 36 which is used to lock the mandrel in the adapter. The angle of engagement between the threaded locking member 36 and the mandrel groove 32 is a safety feature which prevents the mandrel from coming out of the adapter if the threaded member 36 becomes loose. The construction and operation of the mandrel 12 may be conventional and as such is not part of the present invention. The present invention resides in the novel construction of the adapter 10 as will be explained.

The adapter 10 includes a body portion 40 which may be die cast or otherwise formed. The body 40 is constructed to cooperate with mounting means on a honing machine in the usual manner. The body 40 has a forward portion 42 which has a bore formed therein to receive the cylindrical porton 16 of the mandrel. The bore as shown has two angularly related surfaces 44 and 46 (FIG. 6) against which the cylindrical mandrel portion 16 bears when it is mounted therein. The surfaces 44 and 46 are located so that when the threaded member 36 is moved into and against the annular tapered groove 32, the mandrel will be accurately located in the bore by bearing against the bore surfaces 44 and 46. This is highly desirable and is preferred over adapters that have cylindrical bores for receiving cylindrical mandrel portions. This is because it is much easier and more accurate and rigid to locate the mandrel in the adapter using the locating surfaces 44 and 46 than it is to rely on the accuracy of mating cylindrical surfaces. Furthermore, it has been found that by moving the mandrel against the surfaces 44 and 46 during mounting thereof, it is possible to more accurately align the mandrel with respect to a bore being honed and also with respect to the axis of rotation of the honing machine.

The portion of the adapter 10 to the left of the portion 42 as shown in FIG. 1 is substantially U-shaped in cross-section and is defined by a connecting base portion 48, and two spaced and opposed side wall portions 50 and 52. The side walls 50 and 52 are shown having a plurality of strengthening ribs 54 and 56, which extend partway up from the base portion 48. The use of ribs 54 and 56 substantially reduces the material required for the adapter without sacrificing any strength. Also, the end of the U-shaped portion opposite the portion 42 includes thickened wall portions 58 and 60 which together define a space through the rear of the adapter for accommodating those parts of the honing machine that control the axial position of the wedge member 30.

The portion of the adapter shown in FIG. 1 also has a groove 62 formed by a thin wall portion 64. The groove 62 is substantially U-shaped and is provided in the adapter 10 to accommodate one end of a spring member 66 which is shown as being a piece of formed spring wire. The wire that forms the spring 66 has a U-shaped portion 68 at one end which is wider than the groove 62 in which it is mounted so that it must be forced into the groove 62 under pressure to hold it in place. The opposite or outer end of the spring 66 has a sidewardly extending V-shaped portion 70 which cooperates with a notch 71 formed in a sidewardly extending portion 72 of an elongated L-shaped member 74 which extends along the groove 22 in the mandrel to bear against one end of the stone assembly 24. The spring 66 is engaged with the portion 72 in such a manner that the portion 72 is biased somewhat in a clockwise direction as shown in FIG. 1. This in turn moves the free end of the elongated portion of the member 74 downwardly in the groove 22 to prevent it from rising up in or coming out of the groove 22 even under the centrifugal force of high speed operation. This downward pressure also causes the stone assembly which is engaged with the member 74 to retract radially into groove 22 when the wedge member is retracted. The end surface of the L-shaped member 74 opposite from the sidewardly extending portion 72 thereof bears against one end of the stone assembly 24 and biases the stone assembly inwardly.

Figure 3:
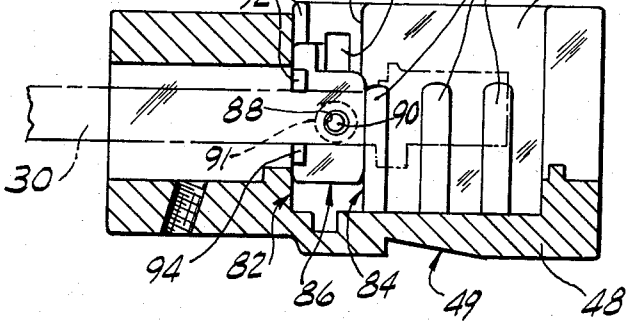
FIG. 3 is a cross-sectional view taken on line 3—3 of FIG. 2.
Figure 2:
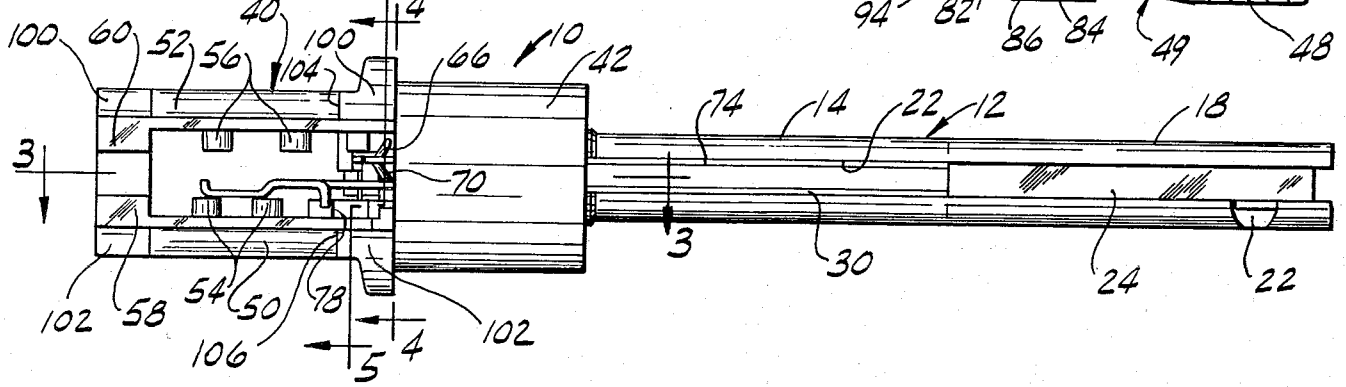
FIG. 2 is a top view of the mandrel and adapter of FIG. 1.

The side wall 50 of the adapter 10 opposite from the side wall 52 on which the spring 66 is located, as shown in FIGS. 2 and 3, has a groove 78 formed therein which communicates with an elongated substantially radially extending opening 80 therethrough. A ridge or track 81 is also formed in the side wall 50 between spaced parallel edges 82 and 84, and an adjustable wedge engaging member 86 is positioned between the edges 82 and 84. The member 86 has a threaded opening 88 therethrough which receives a threaded member 90 that also extends through the opening 80. The threaded member 90 has a head portion 91 which can be tightened by a screwdriver or other like tool to lock the position of the member 86 on the wall 50. The member 86 also has a pair of spaced sidewardly extending portions or studs 92 and 94 which are shown as being rectangular and as being spaced apart a distance approximately equal to the width of the wedge member 30. When the subject adapter has a mandrel mounted on it as described, the wedge 30 extends along the groove 22 in the mandrel and into the space between the adapter walls 50 and 52 where it is engaged by means on the honing machine which are used for adjusting its axial position during a honing operation. It is important, as noted above, particularly for high speed honing, to prevent the wedge 30 including that portion that extends into the adapter 10 from moving radially outwardly in the groove 22 due to centrifugal force. This is accomplished by adjusting the position of the member 86, and particularly the positions of the sidewardly extending studs 92 and 94 between which the wedge 30 extends, so that the wedge 30 can move axially to make adjustments but cannot move radially during operations. Not only does the adjustment of the member 86 limit lateral or radial movement of the wedge 30 but it also establishes the most desirable operation position for the wedge which may vary to some extent from mandrel to mandrel depending on the size of the mandrel and its location relative to the axis of rotation. This adjustment also helps to maintain the most desirable engagement between the wedge 30 and the means on the honing machine which operate the wedge.

FIG. 2, which is a top view, shows more clearly the relationship between the spring 66, the L-shaped member 74 including the sidewardly extending portion 72 thereof, and the wedge member 30. FIG. 2 also illustrates how the present adapter device can be constructed using less material without sacrificing strength mainly because of the provision of the strengthening ribs 54 and 56.

Figure 4:
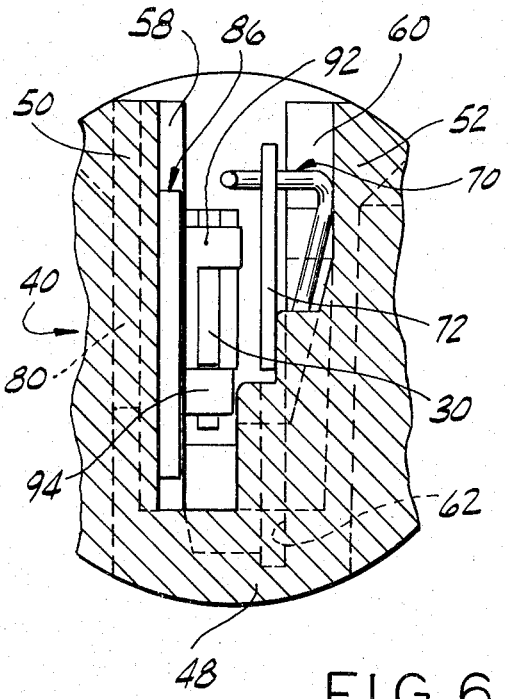
FIG. 4 is a cross-sectional view taken on line 4—4 of FIG. 2.
Figure 5:
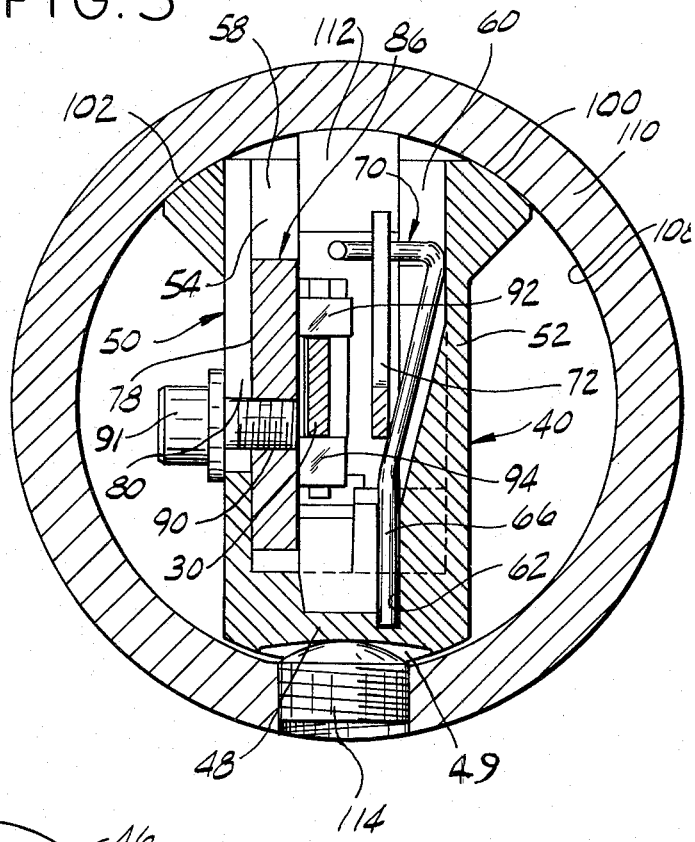
FIG. 5 is a cross-sectional view taken on line 5—5 of FIG. 2 and showing the adapter positioned in a mounting member therefor.
Figure 6:
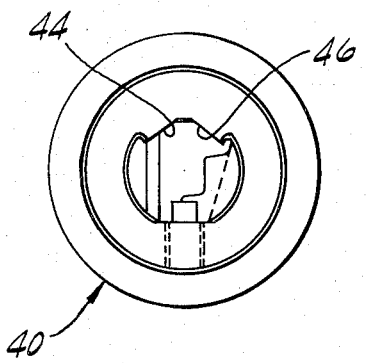
FIG. 6 is a right end view of the adapter portion of the construction shown in FIG. 1.
Figure 7:
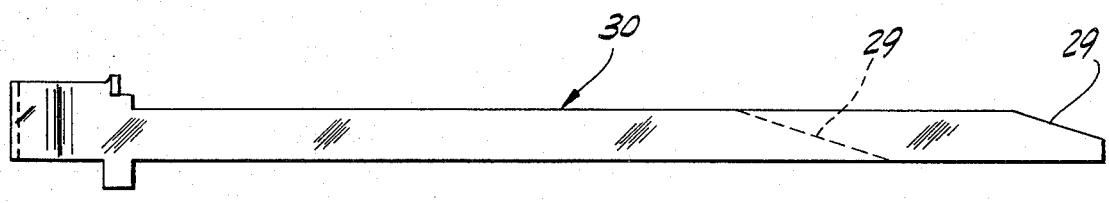
FIG. 7 is a side view of the wedge member for the subject device.
Figure 8:
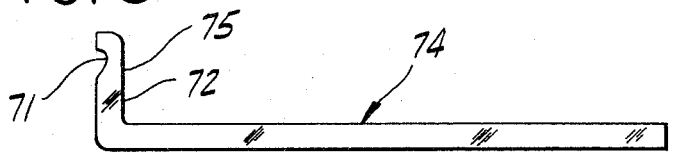
FIG. 8 is a side view of the member used for applying axial and radial tension to the abrasive member.

FIG. 4 better illustrates the shape of the adapter at the junction between the mandrel engaging portion 42 and the U-shaped portion 40 which is also where the spring 66 is located; FIG. 5 is taken very near to FIG. 4 and better illustrates the adapter construction where the member 86 and the spring 66 are located; FIG. 6 is a right end view of the adapter better showing the locations of the mandrel locating surfaces 44 and 46; FIG. 7 shows a typical wedge member 30 for use with the subject device; and FIG. 8 shows the shape of the elongated spring biased member 74 used to apply axial and radial loading force on the abrasive assembly 24. It is apparent that the mandrel mounting means including the locations of the mandrel locating surfaces 44 and 46, and the location of the wedge member 30 will change somewhat depending on the size and diameter of mandrel to be used. For use with very small diameter mandrels the adapter may have its locating surfaces 44 and 46 very near to the axis of the device while for larger diameter mandrels the locating surfaces will be more remote from the axis. This is necessary to assure that each different diameter mandrel will be rotated on or near to its axis for obvious reasons.

Referring again to FIG. 2, spaced side wall portions 50 and 52 are shown formed with spaced lands 100 and 102 located adjacent opposite ends thereof with cut outs or indented portions 104 and 106 respectively therebetween. This is done to increase the accuracy of locating the adapter 10 when mounting it in a cylindrical bore 108 in a spindle assembly 110 on a honing machine. The thickened rear wall end portions 58 and 60 extend toward each other and are spaced apart to receive a locating lug 112 on the spindle 110 therebetween when the adapter 10 is mounted in the spindle bore 108 as shown in FIG. 5. A threaded locking member 114 is mounted in the spindle assembly 110 on the opposite side thereof from the locating lug 112 and when tightened under pressure against the angle surface 49 of the base portion 48 of the adapter 10 forces the side walls 50 and 52 against the spindle surface 108. The angle of engagement between the locking member 114 and the surface 49 also is a safety feature to prevent the adapter 10 from coming out of the spindle 110 if the threaded member 114 becomes loose. When this is done the wall portions 58 and 60 move toward each other and against opposite sides of the locating lug 112 to further tighten and more rigidly and accurately clamp the adapter 10 in the spindle 110. This is possible with the present construction in large part because of the fact that the wall portions 50 and 52 are relatively thinner and somewhat more bendable than adapter wall portions that have been used in prior constructions. The ability to be able to lock and clamp the adapter 10 in accurate position in the spindle assembly 110 is an important advantage over prior constructions.

Thus there has been shown and described a novel adapter construction particularly applicable for mounting a mandrel such as a honing mandrel used to hone cylindrical surfaces, which adapter fulfills all of the objects and advantages sought therefor. It will be apparent to those skilled in the art, however, that many changes, modifications, variations and other uses and applications of the subject adapter are possible and contemplated. All such changes, modifications, variations and other uses and applications which do not depart from the spirit and scope of the invention are deemed to be covered by the invention which is limited only by the claims which follow.

What is claimed is:

1. An adapter for operatively supporting a honing mandrel on a honing machine during a honing operation, the honing mandrel including an elongated member having a groove formed extending along one side thereof and means at one end of the groove for supporting an abrasive work engaging assembly, means formed on one end of the mandrel for mounting the mandrel in the adapter, a wedge member positioned in the mandrel groove and extendable into the adapter, said wedge member having a tapered surface engageable with the abrasive assembly and being axially movable in the mandrel groove to radially reposition the abrasive work engaging assembly therein, the adapter comprising a first portion for receiving said one end of the mandrel and a second substantially U-shaped portion connected to the first portion and including a pair of spaced opposed side walls and a wall portion connected therebetween, means adjacent one end of one of said opposed side walls forming a groove therein opposite the open side of said second U-shaped portion, an elongated spring member of formed material having a substantially U-shaped portion at one end, said U-shaped spring portion being anchored in said adapter groove, and an opposite spring end portion located radially outward from the U-shaped spring end portion adjacent to the open side of the U-shaped second adapter portion, an elongated member extending along the mandrel groove and having one end portion thereof located in the adapter, said one end portion of the elongated member engaging the opposite spring end portion whereby said elongated member is biased by said spring member into engagement with the abrasive work engaging assembly, other means on one of said adapter side walls engageable by the wedge member to prevent radial movements thereof relative to the adapter, and means for adjusting the position of said other means on one of said side walls to accommodate wedge members in different predetermined positions in the adapter.

2. The adapter defined in claim 1 including means forming a pair of angularly related locating surfaces on the first adapter portion for engagement by the one end of the mandrel, and threaded means on the adapter adjustable to move into engagement with the one end of the mandrel to maintain the mandrel in fixed position against said pair of angularly related surfaces.

3. The adapter defined in claim 2 wherein said means for moving the mandrel against the pair of angularly related locating surfaces includes means forming an axially tapered surface on said mandrel, said threaded means on the adapter being adjustable to move against said tapered surface.

4. The adapter defined in claim 1 wherein the unstressed U-shaped end portion of the spring member is larger than the adapter groove so that said U-shaped spring portion must be forced under pressure into said groove, the opposite spring end portion including a substantially V-shaped portion, and means on said elongated member including a notch for engagement with the V-shaped spring portion.

5. The adapter defined in claim 1 wherein said spring member is mounted adjacent to one of the side walls of the second adapter portion and said other means for engaging the wedge member are mounted on the opposite adapter side wall.

6. The adapter defined in claim 5 wherein said opposite adapter side wall includes a transversely extending track, said other means including a member positioned in said track, and means to lock said member in different fixed positions in said track.

7. An adapter for supporting an elongated honing mandrel having a groove formed in one side for receiving a honing assembly and means movable longitudinally in the groove including a member having a beveled surface adjacent one end for cooperating with means on the stone assembly to radially reposition the stone assembly in the groove, the adapter comprising a member having a first portion for receiving the mandrel adjacent to one end thereof and a second portion connected to the first portion and including a pair of spaced wall members and a wall portion connected therebetween, said spaced walls and said wall portion defining an open sided passage through the second adapter portion in position to receive the means movable longitudinally in the mandrel groove, means to bias the stone assembly endwardly in the mandrel groove including an elongated member having one end abutting the honing assembly and an opposite end extending into the adapter, means in the adapter engageable with said elongated member adjacent to the opposite end thereof including a spring member positioned extending substantially transversely in the adapter adjacent to one of the adapter wall members, said spring member having a first portion anchored to the adapter, and a second outwardly extending portion engageable with the opposite end of said elongated member, means on the adapter including a member having spaced transversely extending projections engageable with opposite side edges of the means longitudinally movable in the mandrel groove to limit radial movements thereof, and means for adjusting the position of said member having spaced transversely extending projections on the adapter to control the transverse position of said means longitudinally movable in the mandrel groove.

8. The adapter defined in claim 7 including means forming a pair of angularly related mandrel locating surfaces on the first adapter portion, and threaded means on the adapter in position to move against the mandrel portion that extends into the first adapter portion opposite said locating surfaces to lock the mandrel in fixed position in the adapter and in engagement with said pair of angularly related locating surfaces.

9. The adapter defined in claim 7 wherein said spring member includes a formed wire member having a loop formed at one end and a sidewardly extending projection at the opposite end, and means on the adapter anchoring the loop thereon.

10. An adapter for a honing mandrel used for honing cylindrical bore surfaces, the mandrel including an elongated member having an abrasive assembly positioned in a groove formed therein, an elongated wedge member in said groove longitudinally movable relative to the mandrel and engageable with the abrasive assembly for radially adjusting the position thereof to maintain the abrasive assembly in engagement with the surface being honed, said wedge member having spaced opposite side edges, the improvement comprising an adapter having means thereon for receiving and supporting the honing mandrel, the adapter including a wedge engaging member adjustable thereon to engage opposite side edges of the wedge member to permit longitudinal movement thereof in the mandrel but to prevent radial movements thereof, the adapter also including a pair of angularly related mandrel engaging and locating surfaces against which the mandrel is positioned when installed on the adapter, threaded means on the adapter movable into engagement with the mandrel to maintain the mandrel against the locating surfaces, and an elongated member having one end positioned in the adapter and an opposite end engaged with the abrasive assembly, means on the adapter biasing said elongated member into engagement with the abrasive assembly to maintain the abrasive assembly under longitudinal and radial spring tension in the mandrel groove, said biasing means including an elongated spring member having a first end portion anchored to the adapter, said spring member extending transversely on the adapter and having an opposite end portion engageable with said one end of the elongated member to bias said member in a direction toward the abrasive assembly.

* * * * *

UNITED STATES PATENT OFFICE

CERTIFICATE OF CORRECTION

Patent No. 4,249,348 Dated February 10, 1981

Inventor(s) Harold T. Rutter

It is certified that error appears in the above-identified patent and that said Letters Patent are hereby corrected as shown below:

Column 4, line 37 "on it" should be
--in it--

Signed and Sealed this

*Twenty-first* Day of *April 1981*

[SEAL]

*Attest:*

RENE D. TEGTMEYER

*Attesting Officer* *Acting Commissioner of Patents and Trademarks*